US012653257B2

(12) United States Patent
Goodwin et al.

(10) Patent No.: US 12,653,257 B2
(45) Date of Patent: Jun. 16, 2026

(54) STRETCHABLE BELT

(71) Applicant: Groove Life Corporation, Spring Hill, TN (US)

(72) Inventors: Peter Goodwin, Spring Hill, TN (US); Salmon Nortje, Spring Hill, TN (US); Graham Harrison, Spring Hill, TN (US); Cody Hutchins, Spring Hill, TN (US)

(73) Assignee: Groove Life Corporation, Spring Hill, TN (US)

( * ) Notice: Subject to any disclaimer, the term of this patent is extended or adjusted under 35 U.S.C. 154(b) by 0 days.

(21) Appl. No.: 18/646,711

(22) Filed: Apr. 25, 2024

(65) Prior Publication Data

US 2024/0373962 A1 Nov. 14, 2024

Related U.S. Application Data

(60) Provisional application No. 63/461,845, filed on Apr. 25, 2023.

(51) Int. Cl.
*A41F 9/00* (2006.01)
*A44B 11/25* (2006.01)

(52) U.S. Cl.
CPC ..... *A41F 9/002* (2013.01); *A44B 11/258* (2013.01); *A44D 2203/00* (2013.01)

(58) Field of Classification Search
CPC . A41F 9/002; A41F 1/008; A41F 9/02; A44B 11/258; A44B 11/22; A44B 11/12; A44B 11/24; A44B 11/006; A44B 11/16; A44B 11/008; A44B 2/321; A44B 2/322; A44B 2/338; A44B 2/339; A44B 2/312; A44D 2203/00; Y10T 24/4072; Y10T 24/4016; Y10T 24/4079; Y10T 24/45063; Y10T 24/4736
See application file for complete search history.

(56) References Cited

U.S. PATENT DOCUMENTS 1,406,517 A * 2/1922 Wood ..... A44B 11/00 D11/216
2,400,844 A * 5/1946 Segal ..... A44B 11/008 2/339
2,474,372 A * 6/1949 Schmith ..... A44B 11/00 24/647
3,150,427 A * 9/1964 Rossi ..... A44B 11/24 24/163 R
4,578,827 A * 4/1986 Appelt ..... A41F 1/008 2/221

(Continued)

*Primary Examiner* — Jason W San
*Assistant Examiner* — Rowland Do
(74) *Attorney, Agent, or Firm* — Headland Law & Strategy; Matthew J. Smyth

(57) ABSTRACT

A belt may include a buckle and a strap securable in a loop by the buckle. The strap may include a first outer layer and a second outer layer, a mounting plate secured between the first outer layer and the second outer layer, and a translating buckle mount coupled to the mounting plate. The translating buckle mount may be configured to releasably mount the buckle and to elastically translate back and forth within the mounting plate so that the buckle is movable within the strap relative to the first and second outer layers to vary the circumference of the belt when the belt is worn around a waist of a user.

8 Claims, 8 Drawing Sheets

(56) References Cited

U.S. PATENT DOCUMENTS

| | | | | | |
|---|---|---|---|---|---|
| 4,669,155 | A * | 6/1987 | Chen | A41F 9/002 | 24/191 |
| 5,572,747 | A * | 11/1996 | Cheng | A44B 11/12 | 2/322 |
| 5,579,563 | A * | 12/1996 | Sim | A44B 11/2592 | 24/615 |
| 5,588,186 | A * | 12/1996 | Ko | A44B 11/14 | 24/DIG. 48 |
| 6,108,821 | A * | 8/2000 | Malsoute | A44B 11/008 | 2/338 |
| 8,448,303 | B1 * | 5/2013 | Wall | A41F 9/002 | 2/338 |
| 9,149,090 | B1 * | 10/2015 | Taylor | A44B 11/006 | |
| 9,277,776 | B2 * | 3/2016 | Laatz | A41F 9/002 | |
| 9,351,526 | B1 * | 5/2016 | Taylor | A44B 11/125 | |
| 9,615,631 | B2 * | 4/2017 | Laatz | A44B 11/125 | |
| 9,770,073 | B2 * | 9/2017 | Ryou | A44B 11/16 | |
| 10,219,585 | B2 * | 3/2019 | Taylor | A44B 11/006 | |
| 10,463,119 | B1 * | 11/2019 | Chambers | A44C 5/0061 | |
| 10,548,362 | B1 * | 2/2020 | Hunsucker | A44B 11/125 | |
| 10,966,489 | B2 * | 4/2021 | Rowland | A41F 9/002 | |
| 11,950,663 | B1 * | 4/2024 | Rowland | A44B 11/16 | |
| 12,137,761 | B1 * | 11/2024 | Mulfeld | A42B 1/0188 | |
| 2010/0018008 | A1 * | 1/2010 | Ahn | A44B 11/16 | 24/303 |
| 2012/0174355 | A1 * | 7/2012 | Fraze | A43C 11/1486 | 24/68 A |
| 2016/0309853 | A1 * | 10/2016 | Snyder | A44B 11/12 | |
| 2018/0263322 | A1 * | 9/2018 | Martin | A41D 1/06 | |
| 2024/0074543 | A1 * | 3/2024 | Reese | A44B 1/18 | |

* cited by examiner

STRETCHABLE BELT

CROSS-REFERENCE TO RELATED APPLICATIONS

This application claims priority to U.S. Application Ser. No. 63/461,845, titled "Stretchable Belt with Internal Elastically Translating Buckle Mount," filed on Apr. 25, 2023. This application incorporates the entire contents of the foregoing application herein by reference.

TECHNICAL FIELD

The present disclosure relates generally to the fields of closure devices and straps. More specifically, the present disclosure relates to clothing belts used to secure a user's pants.

BACKGROUND

A belt generally includes a buckle that releasably secures the opposing ends of a strap. Many conventional belts made from generally inelastic materials such as natural leather are uncomfortable to wear because they do not sufficiently flex or stretch with the movement of the wearer, or do not meet the wearer's aesthetic requirements. For example, solid (i.e., non-woven or braided) leather belt straps are typically relatively rigid and can apply undesired pressure around the wearer's waist, especially when transitioning from a standing to a seated position. On the other hand, braided leather belts, though more stretchable than solid leather belts, are typically viewed as casual wear unsuitable for all uses.

To augment user comfort, some belt straps are made entirely out of an elastic material, such as elastic webbing or stretchable polymer foams. Some such elastic belt straps are even coated or sheathed in a faux leather or other leather-like material. Such elastic belt straps do stretch and contract with the movement of the wearer, but in some cases may not adequately secure the wearers pants by virtue of being too stretchable and wearing out. Entirely elastic belt straps are not typically as durable as leather belts because they can be more easily damaged by environmental hazards. Additionally, some clastic materials used in belts can lose their elasticity overtime. Furthermore, completely elastic belt straps are viewed by some consumers as not as aesthetically appropriate as traditional leather belts.

Some manufacturers have recently begun offering solid belts made from two straps of leather linked by a short strip of an elastic material, such as a polymer webbing. However, these belts may be unreliable as they may tear or separate easily, lose elasticity (and thus the ability to contract and adequately secure the wearer's pants), and may look undesirably informal.

SUMMARY

Described herein is a stretchable belt that is durable, comfortable, and aesthetically pleasing. The stretchable belt may have a buckle and a solid (e.g., non-woven) multilayer strap that looks like a traditional solid leather belt strap. The multilayer strap may include non-stretchable and aesthetically pleasing outer layers, which may be leather or another generally inelastic material, and a translating buckle mount that may mount the buckle and may translate relative to the outer layers so that the buckle may slide along the strap as the wearer moves. As such, when pressure is applied to the belt, either by the user or outside force, the translating buckle mount may slide with the buckle, altering the location of the buckle relative to the distal end of the strap to increase or decrease the circumference of the belt of the belt around the user, thereby augmenting user comfort while providing the aesthetic appeal of traditional leather.

DETAILED DESCRIPTION

Referring generally to FIGS. 1-5, there is depicted a stretchable belt 10 configured to be worn around the waist of a user. The belt 10 includes a buckle 12 and a strap 14. The strap 14 is formed from multiple layers of different materials (both elastic and inelastic) and includes an internal elastically translating buckle mount mechanism at least partially disposed within the strap 14. The strap 14 includes outer layers formed from one or more generally inelastic (i.e., non-stretchable) decorative materials, such as leather, that cover the internal elastically translating buckle mount mechanism so that the belt 10 looks aesthetically pleasing.

As explained in more detail below, the internal elastically translating buckle mount mechanism provides a belt 10 that appears to be a traditional solid leather belt, but is instead configured to stretch and contract with the movement of the user and thereby provide greater comfort than traditional leather belts via the internal elastically translating buckle mount mechanism. As used herein, the term "stretch" refers to increasing the overall circumference (i.e., length) of the belt 10 when it is fastened and worn around the waist by a user with the buckle 12 securely engaging both ends of the strap 14 such that the strap 14 forms a loop around the user's waist. As used herein, the term "contract" means to decrease the overall circumference of the belt 10 when it is fastened and worn around the waist.

Figure 1:
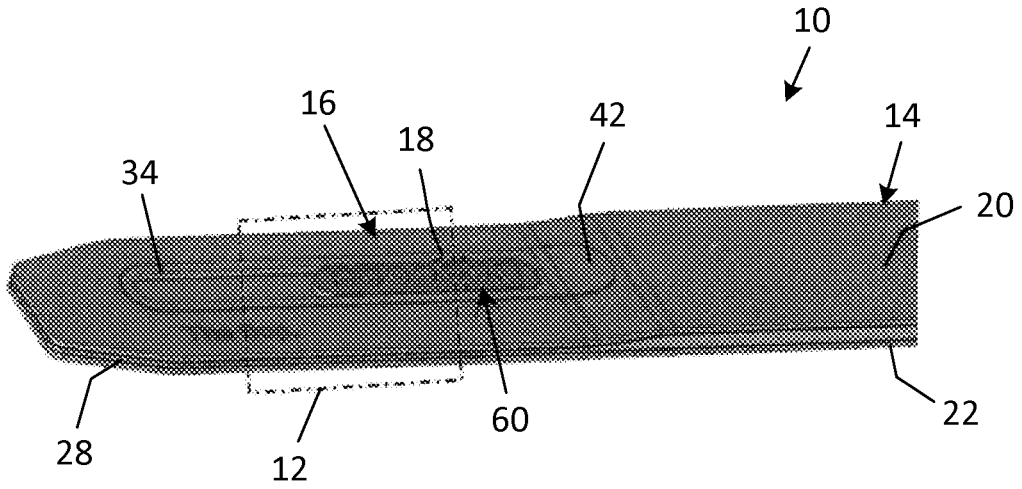
FIG. 1 is an elevated rear perspective view of a stretchable belt comprising a buckle and a strap with an internal elastically translating buckle mount mechanism. The translating mechanism is shown in a retracted position wherein the belt is in an unstretched position.
Figure 2:
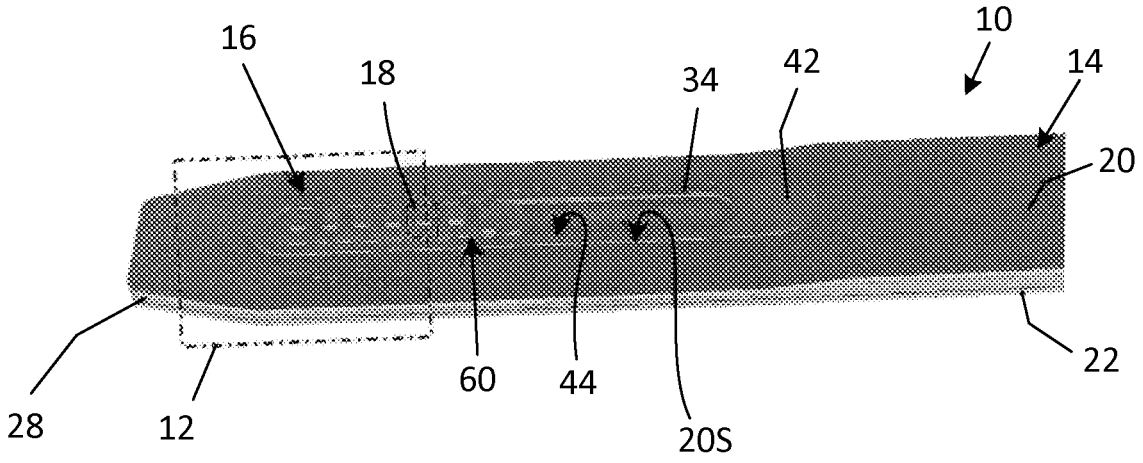
FIG. 2 is an elevated rear perspective view of the strap of FIG. 1. The translating mechanism is shown in an extended position wherein the belt is stretched out to its maximum length.
Figure 3:
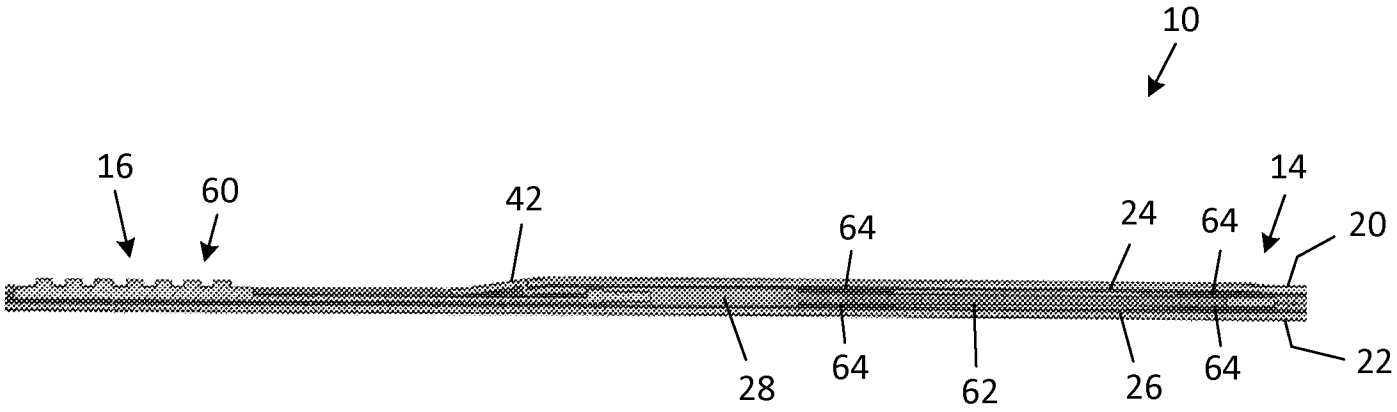
FIG. 3 is a cross-sectional view of the strap of FIG. 2, taken along its longitudinal axis.

The strap 14 houses a translating buckle mount 16. When the belt 10 is fastened snugly around the waist of a user, a translating buckle mount 16, which mounts the buckle 12, can freely slide back and forth with the buckle 12 relative to the other members of the strap 14, between a fully retracted position (FIG. 1) and a fully extended position (FIG. 2) to automatically adjust how the belt 10 fits the user's waist. When the buckle 12 and translating buckle mount 16 move distally (i.e., to the left as depicted in FIGS. 1-2 or toward the tongue or free end of the belt 10), the circumference of the fastened belt 10 is increased, and when the buckle 12 and the translating buckle mount 16 move proximally (i.e., to the right as depicted in FIGS. 1-2 or toward the end to which the buckle is fixed) the circumference of the fastened belt 10 is decreased.

For example, in use, a user can secure the belt 10 snugly but comfortably around the waist while standing. When the user sits, the user's waist typically expands. A person wearing a traditional solid leather belt would experience discomfort while sitting because such a belt would then feel tighter around the expanded waist due to the inelasticity of the leather. By contrast, the translating buckle mount 16 of the instant belt 10 allows the belt 10 to flex, stretch, and expand considerably more than traditional solid leather belts by automatically increasing (i.e., stretching) or decreasing (i.e., contracting) its circumference when it is fastened around the user. As such, a seated user wearing a belt 10 disclosed herein would feel less discomfort due to the tightness of the belt 10 relative to a traditional solid leather belt due to the mechanically facilitated stretchability of the instant belt 10.

Turning again to FIGS. 1-5, the buckle 12 selectively couples the ends of the strap 14 to one another. The buckle 12 is shown in phantom by the dot-dashed boxes indicated in FIGS. 1-2. It is to be understood that the buckle 12 can comprise a monolithic or multipart body, such as that disclosed in U.S. Pat. No. 11,510,463, which is hereby incorporated herein by reference. The buckle 12 can be releasably coupled to the translating buckle mount 16 at a first end of the strap 14. The buckle 12 moves in tandem with the translating buckle mount 16 to increase or decrease the circumference of the looped belt 10 when the belt 10 is worn around the user. The buckle 12 includes a mating member 18 that matingly engages with a corresponding feature, such as a tooth, on the translating buckle mount 16. The mating member 18 may comprise a protrusion, a recess, teeth, grooves, and/or hook and/or loop fasteners. In other embodiments, the buckle 12 can include a magnet or an adhesive material, while the mating member 18 can include a complimentary magnet or adhesive material.

Figure 4:
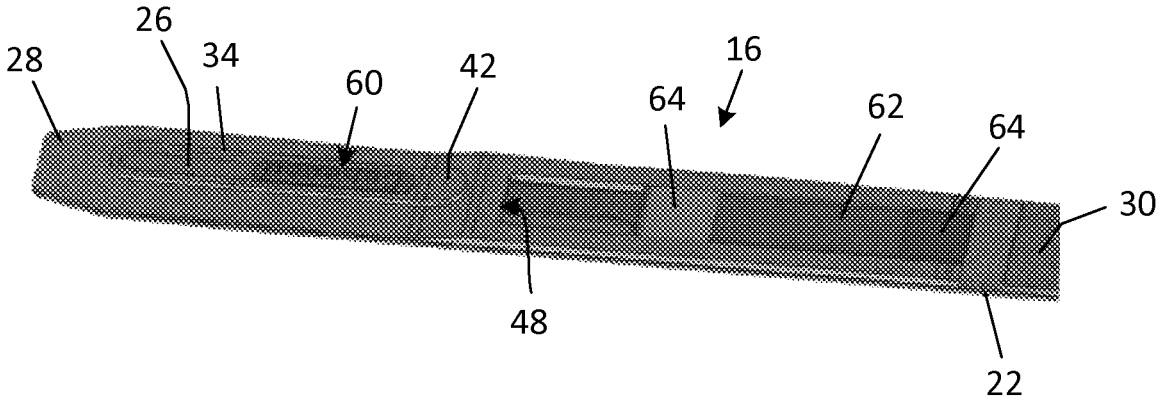
FIG. 4 is another elevated rear perspective view of the strap of FIG. 1, showing the strap without its aesthetic layer.
Figure 5:
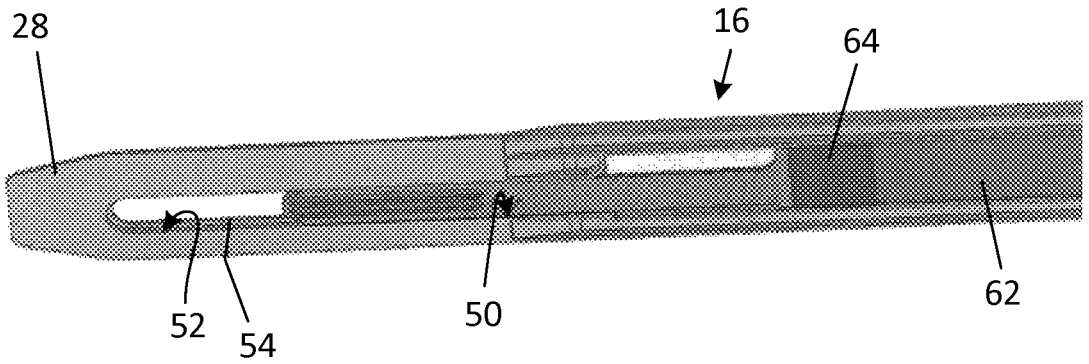
FIG. 5 is an elevated front perspective view of the strap of FIG. 1, showing the mounting plate and translating buckle mount in isolation.

The strap 14 comprises two outer layers 20, 22, two inner layers 24, 26, and a mounting plate 28 which mounts the translating buckle mount 16. At least one end of the strap 14 is connected to the buckle 12. The strap can be permanently or releasably connected to one or more parts of the buckle 12. The strap 14 may further comprise an insert 30, such as a plastic insert, disposed within the layers 20, 22 and 24, 26 (FIG. 4).

The layers of the strap can comprise two aesthetic outer layers 20, 22 and two support layers 24, 26. The outer layer 20, at the inside of the belt 10, has a slot 20S for receiving the translating buckle mount 16 therein (see FIG. 2). The aesthetic outer layers 20, 22 can comprise any desired typically non-stretchable material(s), such as leather. However, it is contemplated that a wide variety of other materials can be used to form aesthetic layers 20, 22. The support layers 24, 26 comprise inside and outside support layers 24, 26 that support and partially encapsulate the translating buckle mount 16 inside the outer layers 20, 22 of strap 14. The inside support layer 24 has a slot (unnumbered) for receiving the translating buckle mount 16 therein. The support layers 24, 26 can be formed from a low-friction material, such as polytetrafluoroethylene (PTFE).

Figure 6:
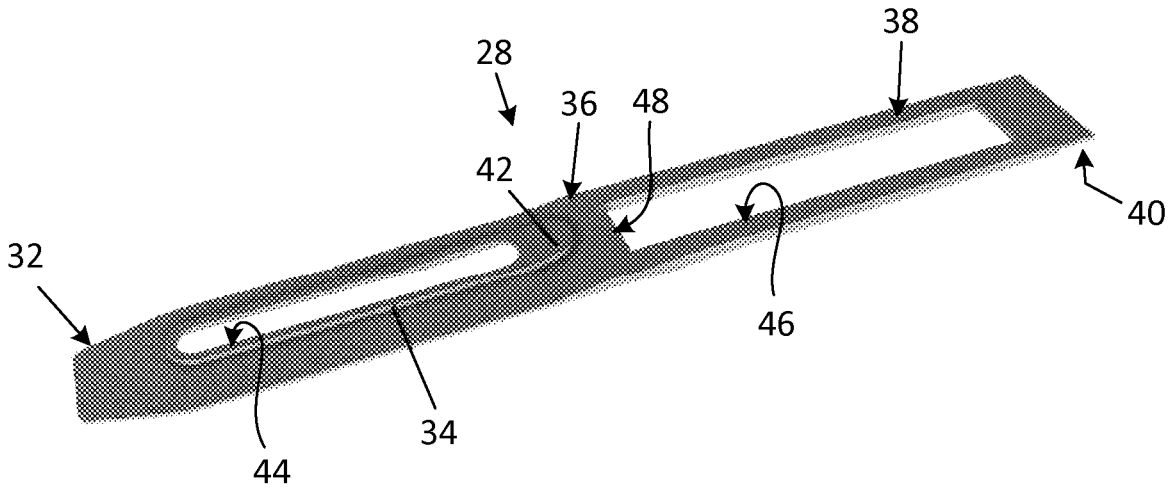
FIG. 6 is an elevated rear perspective view of the mounting plate in isolation.
Figure 7:
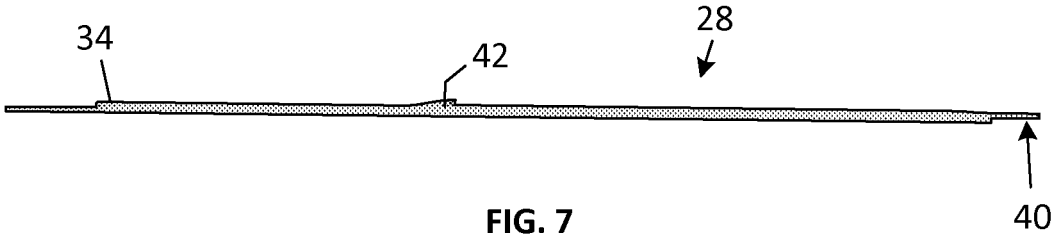
FIG. 7 is a top plan view of the mounting plate of FIG. 6.
Figure 8:
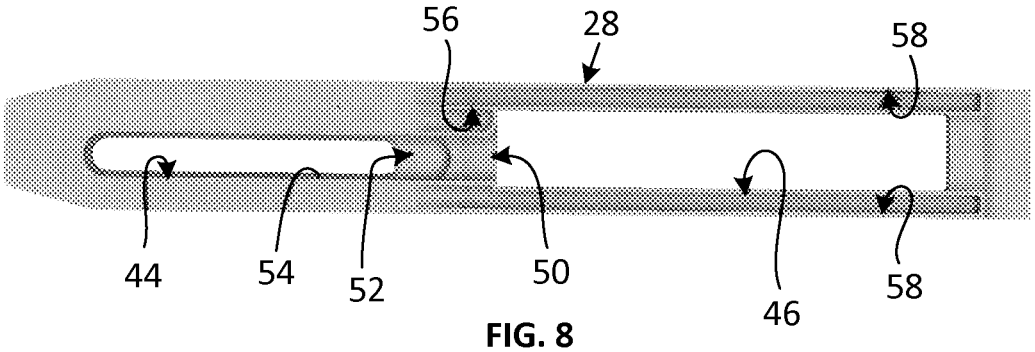
FIG. 8 is a front plan view of the mounting plate of FIG. 6.

Referring now to FIGS. 6-8, there is shown the mounting plate 28 in isolation. The mounting plate 28 is configured to mount the translating buckle mount 16 and serve as a mechanical stop for setting the travel distance of the translating buckle mount 16. The mounting plate 28, from left to right in FIG. 6, has a distal section 32 defining a first tier having a first thickness, a plateau member 34, a tapered middle section 36 extending proximally away from the distal section 32, and a proximal section 38 defining a second higher tier having a second greater thickness and extending proximally from the middle section 36. The proximal section 38 mates with and can be joined to the insert 30. The outer surfaces of the distal, middle, and proximal sections 32, 36, 38 are coplanar, except for the proximal end of the proximal section of the mounting plate 28 which may have a groove or chamfer 40 therein for mating with the insert 30. The mounting plate 28 may comprise any desired material, such as metal, plastic, or fabric.

The plateau member 34 spans from the distal section 32 to the middle section 36. The proximal end 42 of the plateau member 34 is located slightly above the inner aesthetic layer 20 and serves as a tapered mechanical stop 42 so that the buckle 12 contacts the plateau member 34 instead of contacting and potentially damaging the inner aesthetic layer 20 during translation. The taper of the proximal end 42 of the plateau member 34 may be substantially identical to or slightly larger than, such as 1-10 degrees greater than, the taper of the middle section 36.

The mounting plate 28 also comprises a ratchet slot 44 in the plateau member 34 and a biasing member slot 46 in its proximal section 38. The plateau member 34 effectively raises the location of the ratchet slot 44 so that the top of the ratchet slot 44 is coplanar with the top of the biasing member slot 46. When assembled, the mounting plate 28 is covered by the layers 20, 22, 24, 26 of the strap 14, except for the plateau member 34 and the ratchet slot 44 therein.

The mounting plate 28 may also comprise one or more integrated mechanical stops for setting the travel distance of the translating buckle mount 16. For example, the distal wall 48 of the perimeter of the biasing member slot 46 may serve as a mechanical stop 48, which sets the maximum distal limit that the translating buckle mount 16 can travel to increase the circumference of the belt 10.

The mounting plate 28 may further comprise one or more guide channels 50, 52 for receiving and guiding the translating buckle mount 16. A lip 54 circumferentially surrounds the ratchet slot 44 (FIG. 8). Additionally, the mounting plate 28 may further comprise structural recesses 56, 58 for decreasing the overall weight of the mounting plate 28.

Referring now to FIGS. 3-5 and 9-11, the translating buckle mount 16 comprises a sliding rail member 60 and a biasing member 62 connected to the rail 60 via one or more fasteners 64. The biasing member 62 is also connected to the mounting plate 28 and the rail 60 via one or more fasteners 64. The fasteners 64 connect the biasing member 62 to the mounting plate 28 and the rail 60. The fasteners 64 can be lap joints that overlap onto respective portions of the mounting head 72 of the rail 60, the biasing member 62, and the mounting plate 28. Other types of joints suitable to connect the biasing member 62 to the mounting plate 28 and the rail 60 exist and are contemplated herein. The biasing member 62 is disposed within the biasing member slot 46 of the mounting plate 28 and is configured to bias the rail 60 toward the retracted position. The biasing member 62 can be any stretchable resilient member or elastic material that creates a resistance to a pulling force. Suitable biasing members include an elastic band such as a strip of elastic webbing or other resilient material, an extension spring, a rubber band, and the like. When assembled, the translating buckle mount 16 is substantially embedded within and protected by (e.g., encapsulated by) layers 20, 22 of strap 14.

Figure 9:
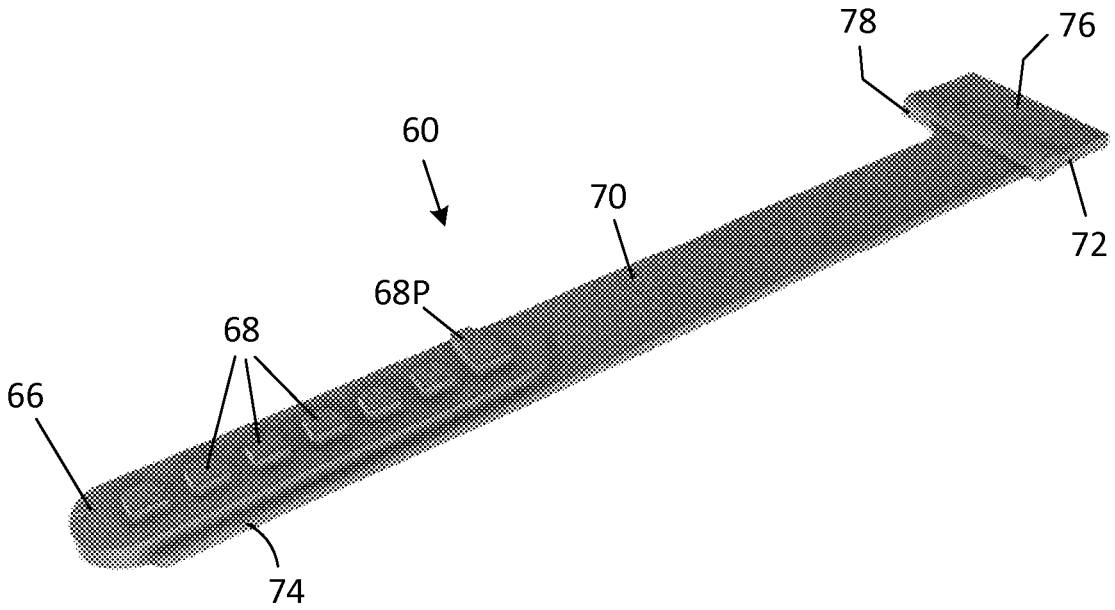
FIG. 9 is an elevated rear perspective view of the sliding rail of the translating buckle mount in isolation.
Figure 10:
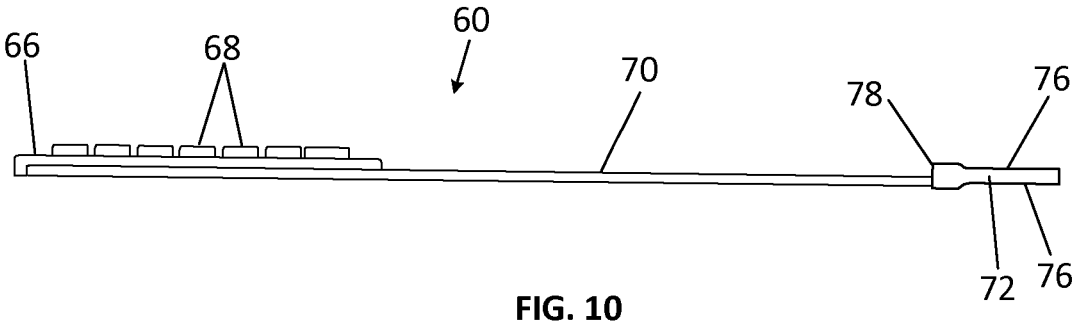
FIG. 10 is a top plan view of the sliding rail of FIG. 9.
Figure 11:
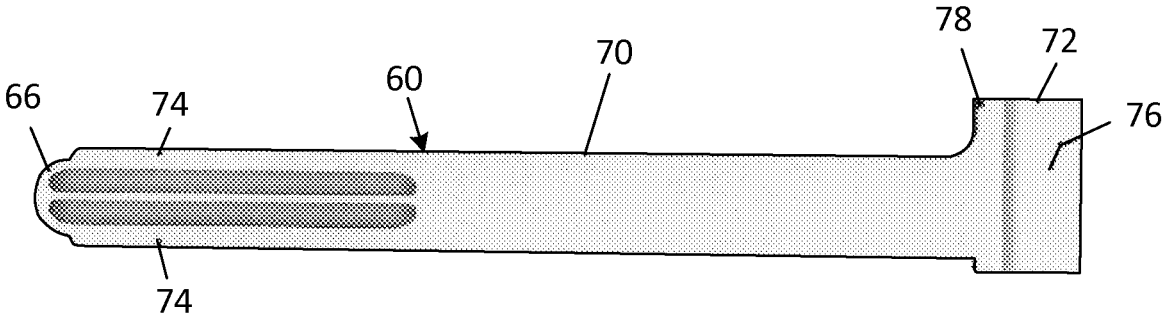
FIG. 11 is a front plan view of the sliding rail of FIG. 9.

As best shown in FIGS. 9-11, the sliding rail 60 comprises a buckle connector in the form of an elliptical ratchet portion 66 with teeth 68 formed on a surface thereof, an elongated stem portion 70 extending proximally from the ratchet portion 66, and a mounting head portion 72 connected to the elongated stem portion 70. The rail 60 is configured to mount the buckle 12 to the strap 14 in one of several optional positions via the teeth 68 on ratchet portion 66. This allows a user to set the buckle 12 to a position on rail 60 that is comfortable for the user while standing, like a traditional solid leather belt, so that the internal elastically translating mechanism will allow the belt 10 to stretch and remain comfortable when the user sits down. In some embodiments, the rail 60 can be configured as a one-way lateral ratchet for mounting the buckle 12 in one of multiple indexed positions. When assembled, the rail 60 is disposed and slides within the slots 44, 46 and the guide channel(s) 50, 52 of the mounting plate 28 (see FIGS. 2 and 4-6). The rail 60 may comprise any desired material, such as metal, plastic, or fabric. The ratchet portion 66 with teeth 68 is preferably formed from a hard or rigid material, such as metal or plastic.

The ratchet portion 66 releasably engages the buckle 12. When assembled with the mounting plate 28, the ratchet portion 66 fits within and extends through the ratchet slot 44. The ratchet portion 66 extends beyond the mounting plate 28 such that when the buckle 12 is connected to the ratchet portion 66 the buckle 12 is free to slide relative to the mounting plate 28 and layers 20, 22, 24, 26, which remain stationary. In this way, the buckle 12 slides with the buckle mount 16 along a portion of the length of the strap 14 to expand the circumference of the belt 10 when the user sits down or otherwise needs more space. The teeth 68 of the ratchet portion 66 provide various indexed positions for adjustably mounting the buckle 12 thereon. The endmost tooth 68P at the proximal end of the ratchet portion 66 may be larger than the other teeth 68 for setting a last indexed position (FIG. 9). Instead of teeth 68, it is conceivable that the elliptical ratchet portion 66 may comprise one or more other types of protrusions and/or recesses for receiving a corresponding protrusion and/or recess of the buckle 12. Additionally, the ratchet portion 66 may have one or more structural recesses therein for reducing the overall weight of the rail 60. In some embodiments, the ratchet portion 66 can have a different shape entirely, so long as the portion 66 can still be releasably engaged with the buckle 12.

The elongated stem portion 70 extends in between the ratchet portion 66 and the mounting head portion 72. The elongated stem portion 70 defines a pair of lips 74 on each lateral side of the ratchet portion 66. The lateral lips 74 of the elongated stem portion 70 matingly engage with the secondary recessed channel 52 (i.e., lip 54) in the mounting plate 28 (see FIGS. 4-5).

The mounting head portion 72 is connected to the proximal end of the elongated stem portion 70. The mounting head 72 is configured to connect to the biasing member 62. In more detail, the mounting head 72 has a pair of carveouts which define inner and outer mounting platforms or shelves 76 for receiving the fastener 64 and coupling the biasing member 62. The mounting head 72 is offset from the elongated stem 70 such that the rail 60 forms an approximate "L"-shape. Due to the offset relationship between the mounting head 72 and the elongated stem 70, the mounting head 72 aligns with (i.e., is coaxial with) the biasing member slot 46, whereas the elongated stem 70 and the ratchet portion 66 are aligned with the ratchet slot 44. This offset relationship of the rail 60 (and ratchet and biasing member slots 44, 46) provides additional space for the buckle 12 such that it allows a button of the buckle 12 to slide transversely to (dis) engage with the ratchet member 66, as discussed in more detail below.

When assembled, the mounting head 72 is received within the biasing member slot 46 of the mounting plate 28. The distal wall 78 of the mounting head 72 is engageable with the mechanical stop 48 of the mounting plate 28 (i.e., the distal wall 48 of the biasing member slot 46) to limit the stretch of the belt 10 and prevent the biasing member 62 from becoming inelastic or damaged. Additionally, when assembled, the lateral sides of the mounting head 72 matingly engage with the inside walls of the biasing member slot 46.

In operation, the user may don the belt 10 and fasten the buckle 12 onto the strap 14 by coupling the buckle 12 to the ratchet portion 66 of the rail 60. The user can select a desired position of the buckle 12 by sliding the buckle 12 to the desired position on the teeth 68 similar to a traditional belt. Once the belt 10 is fastened around a user's waist, the translating buckle mount 16 and the buckle 12 slide in unison, allowing the belt 10 to stretch or contract as appropriate to accommodate any movement of the user, such as that involved when moving from a standing to sitting position or vice/versa.

More specifically, the buckle mount 16 is configured to translate back and forth within the mounting plate 28 along a range of positions between its fully retracted position (FIG. 1) and fully extended position (FIG. 2). The circumference of the belt 10, when looped and fastened around the waist of a user, is greatest in the fully extended position and smallest in the fully retracted position. In the fully retracted position, the biasing member 62 is retracted and the rail 60 can abut the proximal end of the ratchet slot 44 (FIG. 1). In the fully extended position, the biasing member 62 is extended or stretched and the distal wall 78 of the mounting head member 72 can abut the distal wall 48 of the biasing member slot 46 of the mounting plate 28 (FIG. 2), while the rail 60 can abut the distal end of the ratchet slot 44. Since the buckle 12 is allowed to slide along (i.e., relative to) the strap 14, the circumference of the belt 10, when the belt 10 is looped and fastened around the user, can change (by virtue of the biasing member 62 stretching or contracting) to accommodate movement of the user.

As such, the presently disclosed stretchable belt 10 provides far more versatility and comfort to a user than a conventional leather belt. The stretchable belt 10 also provides the aesthetics of a conventional leather belt but with the functionality of an elastic belt. Further, the stretchable belt 10 is more durable than a conventional belt with a completely elastic strap because the translating buckle mount 16 is substantially embedded within (i.e., encapsulated by) and protected by the layers 20, 22, 24, 26 of the strap 14.

Figure 12:
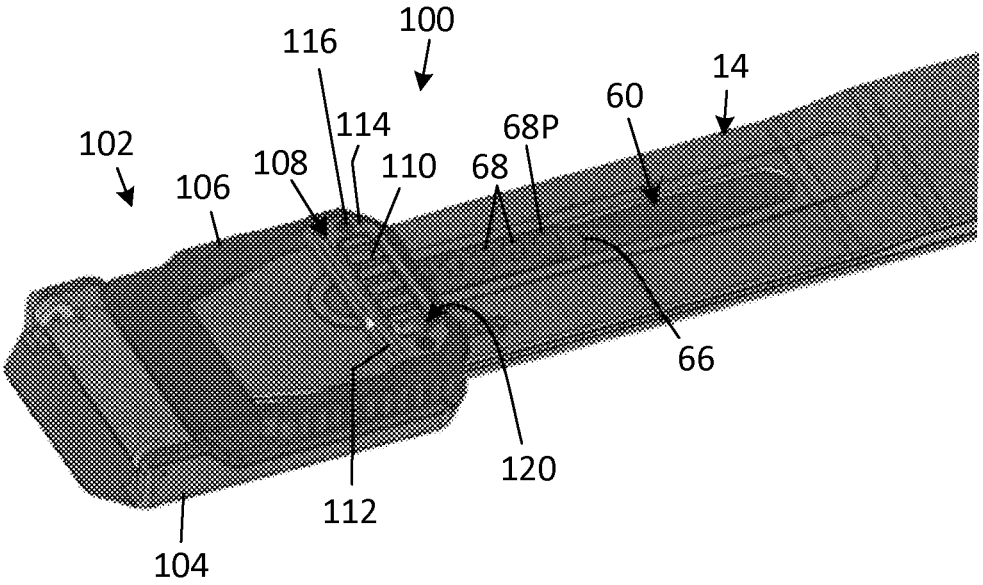
FIG. 12 is an elevated rear perspective view of another embodiment of a stretchable belt comprising a multipart buckle and a strap with an internal elastically translating buckle mount mechanism. The translating mechanism is shown in an extended position.
Figure 13:
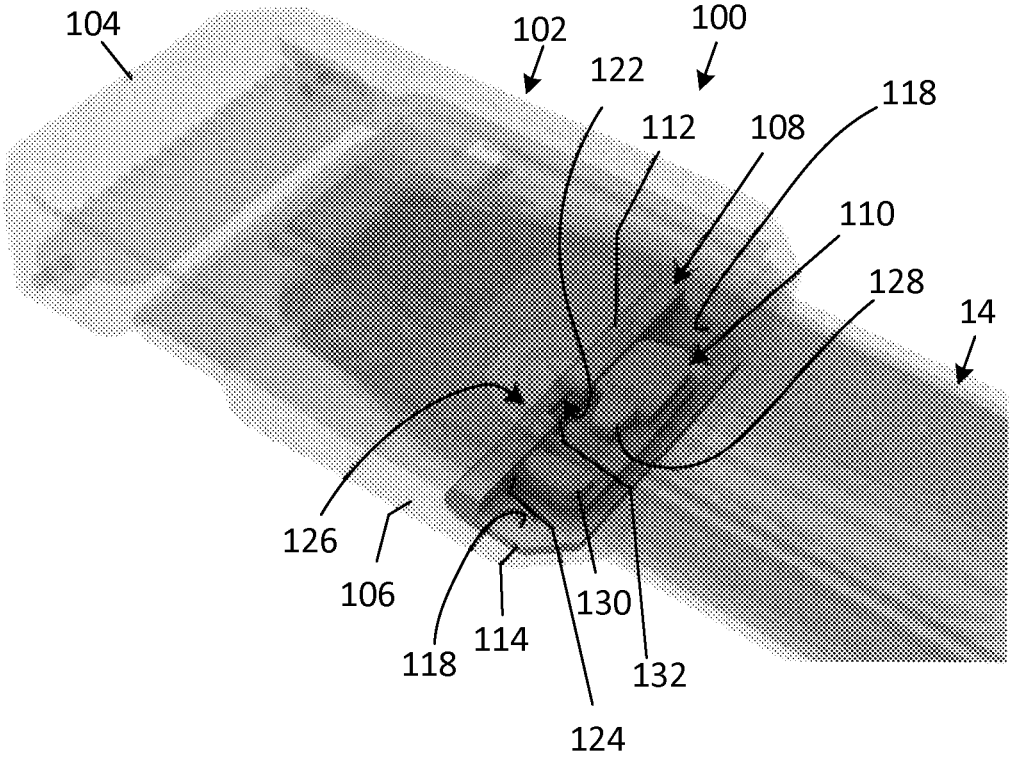
FIG. 13 is an elevated rear perspective and skeleton view of the buckle of FIG. 12.

Referring now to FIGS. 12-13, there is shown another embodiment of a belt 100 with a buckle in the form of a multipart buckle 102 with two or more buckle members 104, 106. The multipart buckle 102 may be substantially similar to the buckle of U.S. Pat. No. 11,510,463, which is incorporated herein by reference. However, the buckle 100 disclosed herein can further include a button mount 108 and button 110 disposed therein that selectively engages with the teeth 68 of the translating buckle mount 16. As such, the multipart buckle 102 may comprise a male and a female buckle member 104, 106 that magnetically couple to one another via internally disposed magnets as taught in U.S. Pat. No. 11,510,463.

The button mount 108 on the female buckle member 106 comprises an elongated rail 112 and a lip 114 extending laterally outward from the rail 112. The button mount 108 is attached to the body of the female buckle member 106 via one or more fasteners 116, such as screws disposed in fastener holes 118 in the lip member 114. The button mount 108 has a button slot 120 in its lip 114 for receiving the button 110 therein. The button slot 120 defines a travel distance of the button 110. The button mount 108 may also include a longitudinal guide channel 122 in the rail member 112 for receiving one or more corresponding protrusions or rails 124 of the button 110 therein (FIG. 13). The guide channel 122 is parallel to the button slot 120.

The button mount 108 may also comprise a ratchet cutout 126 that transversely extends through the rail 112. The ratchet cutout 126 allows the teeth 68 of the ratchet portion 66 of the translating buckle mount 16 to pass therethrough, which accordingly allows the buckle 102 to be mounted in various indexed positions relative to the teeth 68. The ratchet cutout 126 is larger than the teeth 68 so that they pass through unincumbered. However, the ratchet cutout 126 is not larger than the endmost locking tooth 68P of the ratchet portion 66. In this way, the ratchet cutout 126 provides a travel pathway for the teeth 68 to pass therethrough, but the endmost tooth 68P can still abut the rail 112, on either side of the ratchet cutout 126, for setting the last indexed position.

The button 110 slides back and forth within the button slot 120 of the button mount 108. The button 110 comprises the mating protrusion 124 and one or more mechanism mating features, such as a tooth 128 and guard rail 130, that matingly engage with the teeth 68 of the ratchet member 66. The mating protrusion 124 protrudes laterally outwardly from the main body of the button 110. When assembled, the mating protrusion 124 extends into the guide channel 122 of the button mount 108. The mating protrusion 124 also engages with the underside surface of the button mount 108 to accordingly lock the button 110 in place.

The buckle 102 can include a biasing member 132 which biases the button 110 toward its engaged position. For example, as shown in FIG. 13, a biasing member 132 may be disposed in the guide channel 122 of the button mount 108 and act against the mating protrusion 124 of the button 110 to bias the button 110 toward engagement with teeth. Biasing member 134 can be, for example, a compression spring.

Figure 14:
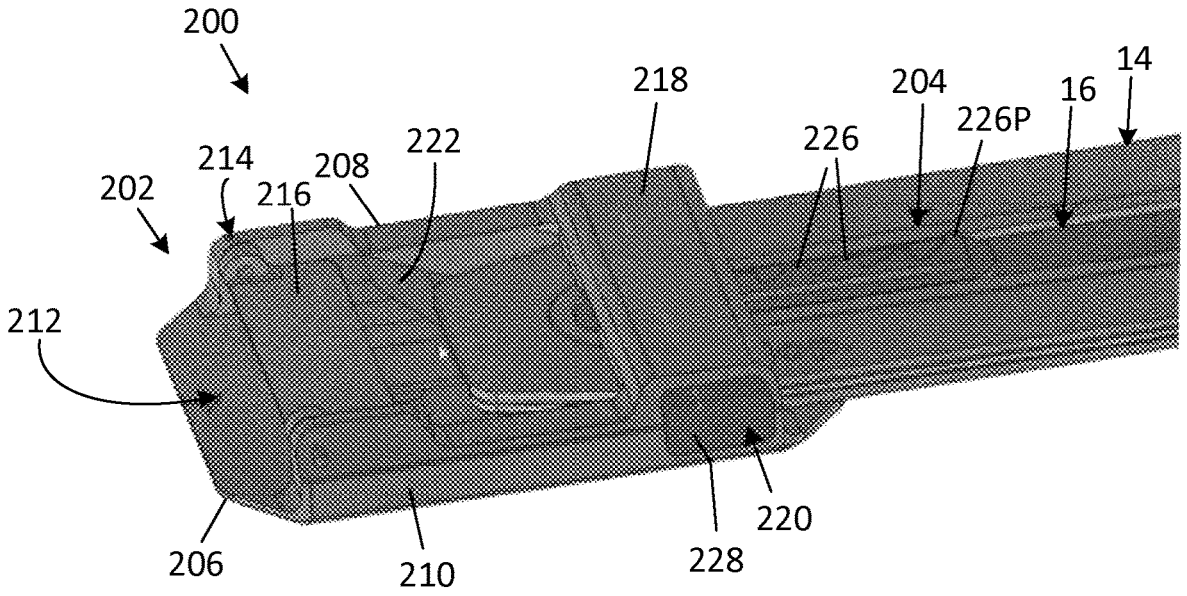
FIG. 14 is an elevated rear perspective view of another embodiment of a stretchable belt comprising a buckle and a strap with an internal elastically translating buckle mount mechanism. The translating mechanism is shown in an extended position.
Figure 15:
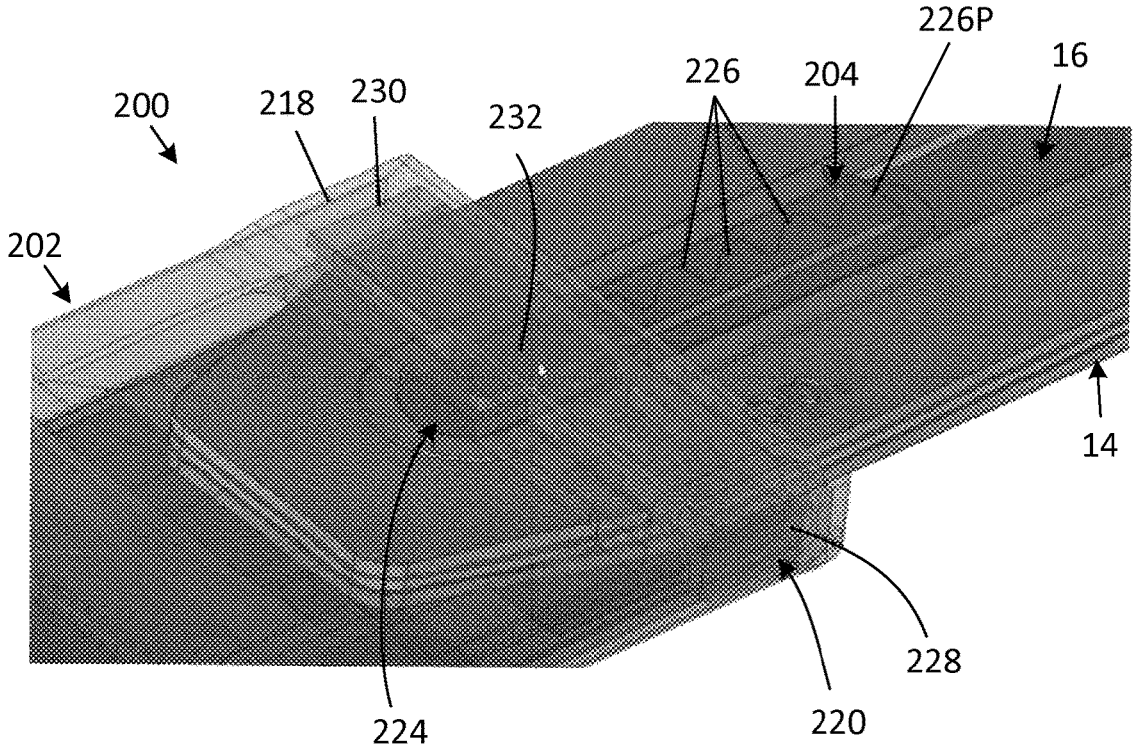
FIG. 15 is an elevated rear perspective view of the belt of FIG. 14, wherein the buckle is shown in a skeleton view.
Figure 16:
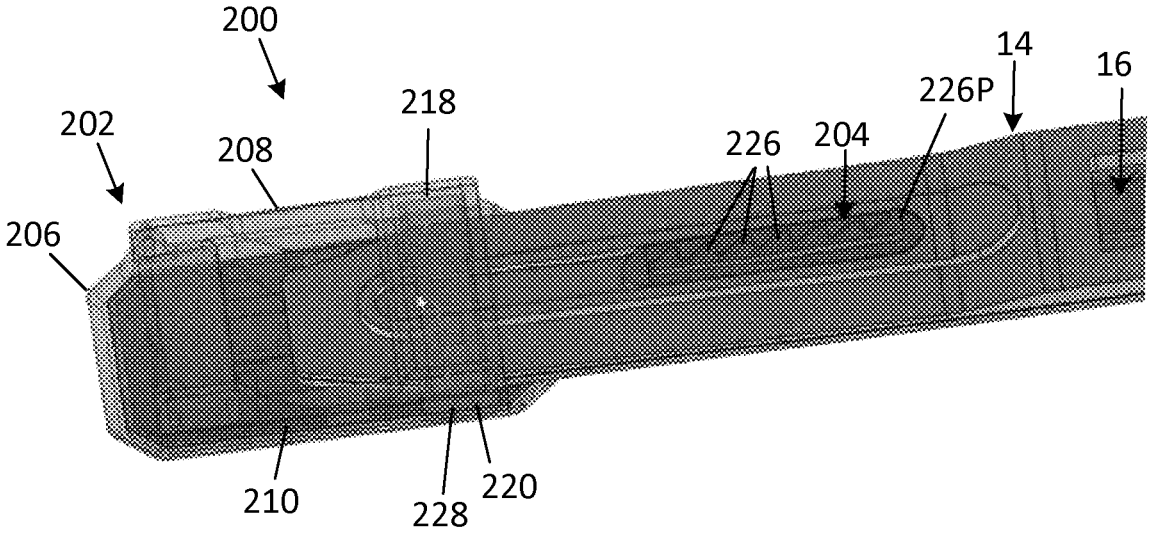
FIG. 16 is another elevated rear perspective view of the belt of FIG. 14, wherein the buckle is shown in a skeleton view. The translating mechanism is shown in a retracted position.

Referring now to FIGS. 14-16, there is shown another embodiment of a belt 200. The belt 200 may be substantially similar to the belt 10, except for the buckle 202 and the ratchet member 204 of the translating buckle mount 16.

The buckle 202 is configured as a monolithic or single part buckle 202. The buckle 202 comprises a façade member 206, top and bottom rails 208, 210 defining a strap channel 212 therebetween for receiving both ends of the strap 14 therethrough, a clamp mount 214 for mounting a toothed clamp 216, and a button mount 218 for mounting a lateral side button 220. The top and bottom rails 208, 210 may each additionally include inner and curved strap guides 222 for guiding the end of the strap 14 as it passes through the channel (only one strap guide 222 being shown in FIG. 14).

The button mount 218 extends above and over the strap channel 212. The button mount 218 comprises a button opening (unnumbered) for receiving the button 220 therein. The button mount 218 may also comprise a ratchet cutout 224 that extends transversely through the body of the button mount 218 and into its channel facing surface (FIG. 15). The ratchet cutout 224 allows the teeth 226 of the ratchet member 204 of the translating buckle mount 16 to pass therethrough, which accordingly allows the buckle 202 to be mounted in various indexed positions on teeth 226. The ratchet cutout 224 is wide enough to allow the teeth 226 to pass therethrough, but the ratchet cutout 224 is not larger than the endmost locking tooth 226P to accordingly set the last indexed position.

The button 220 comprises a head member 228, a rail member 230, a transverse channel (unnumbered) in the rail member 230, and a tooth 232 extending inwardly into the channel which accordingly engages with corresponding teeth 226 in the ratchet member 204 of the translating mechanism (FIG. 15). The button 220 may also comprise one or more lateral rails that engage with corresponding channels within the button opening of the button mount 218 (unnumbered). The button 220 can include a biasing member which biases the button 220 toward an engaged position wherein the tooth 232 of the button 220 engages the teeth 226 of the ratchet member 204.

To facilitate the understanding of the embodiments described herein, a number of terms are defined below. The terms defined herein have meanings as commonly understood by a person of ordinary skill in the areas relevant to this disclosure. Terms such as "a," "an," and "the" are not intended to refer to only a singular entity, but rather include the general class of which a specific example may be used for illustration. The terminology herein is used to describe specific embodiments, but their usage does not delimit the scope, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The upright position of the belt is determined when the belt is worn by a user. Therein, the front of the belt faces outwardly when worn by the user, and the rear of the belt faces inwardly toward the user when worn by the user. The bottom of the belt is its bottom side which faces downwardly to the ground and the top of the belt is the top side which faces upwardly. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment. All measurements should be understood as being modified by the term "about" regardless of whether the word "about" precedes a given measurement. In general, "about," "approximately" or "substantially" may mean within 1%, or 5%, or 10%, or 20%, or 50%, or 100% of a nominal value.

The specific embodiments discussed herein are merely illustrative and do not delimit the scope. Many other variations are possible, and modifications may be made to adapt a particular situation or material to the teachings provided herein without departing from the essential scope thereof. Therefore, it is intended that the scope include all aspects falling within the scope of the appended claims.

What is claimed is:

1. A belt, comprising:

a buckle; and a strap securable in a loop by the buckle, the strap comprising:

a first outer layer and a second outer layer;

a mounting plate secured between the first outer layer and the second outer layer; and a translating buckle mount coupled to the mounting plate, the translating buckle mount configured to releasably mount the buckle and to elastically translate back and forth within the mounting plate so that the buckle is movable within the strap relative to the first and second outer layers to vary the circumference of the belt when the belt is worn around a waist of a user.

2. A belt, comprising:

a buckle;

a strap securable in a loop by the buckle, the strap comprising:

a first outer layer and a second outer layer;

a mounting plate secured between the first outer layer and the second outer layer, the mounting plate having a distal end and a proximal end, a ratchet slot closest to the distal end and a biasing member slot closest to the proximal end;

a buckle mount comprising a sliding rail member that is configured to translate within the ratchet slot, which buckle mount has a plurality of teeth; and a biasing member disposed in the biasing member slot and having a first end and a second end, the first end being coupled to the sliding rail member and the second end being coupled to the proximal end of the mounting plate, wherein the biasing member exerts an elastic force on the sliding rail member that biases the sliding rail member toward the biasing member slot;

wherein the buckle is configured to selectively engage with one tooth of the plurality of teeth to establish an initial circumference of the belt; and wherein the translation of the sliding rail member against the elastic force is configured to facilitate expansion of a circumference of the belt, beyond the initial circumference.

3. The belt of claim 2, wherein the sliding rail member has an elongated stem portion extending away from the teeth that terminates in a mounting head.

4. The belt of claim 3, wherein the mounting plate includes a guide channel that engages with the elongated stem portion to facilitate translation of the sliding rail member parallel to a length of the belt.

5. The belt of claim 4, wherein the sliding rail member includes a lip that engages with the guide channel.

6. The belt of claim 3, wherein the mounting plate includes a mechanical stop that is configured to engage with the mounting head to limit translation of the sliding rail member away from the biasing member slot.

7. The belt of claim 2, wherein at least one of the first outer layer and the second outer layer is a non-stretchable material.

8. The belt of claim 7, wherein the non-stretchable material is leather.

* * * * *